United States Patent [19]

Hong

[11] 4,358,870

[45] Nov. 16, 1982

[54] HYDRAULIC HINGE WITH DOOR CLOSING MECHANISM

[76] Inventor: Chang H. Hong, 36, Lane 530, Sec. 1, Chung-Shan Rd., Chang-Hua City, Taiwan

[21] Appl. No.: 177,938

[22] Filed: Aug. 14, 1980

[51] Int. Cl.[3] ..... E05F 3/04

[52] U.S. Cl. ..... 16/53; 16/58

[58] Field of Search ..... 16/52, 53, 54, 58, 68, 16/DIG. 9

[56] References Cited

U.S. PATENT DOCUMENTS

| | | | |
|---|---|---|---|
| Re. 15,082 | 4/1921 | Franckaerts | 16/54 |
| 491,898 | 2/1893 | Lowe | 16/54 |
| 1,937,685 | 12/1933 | Burdick et al. | 16/53 |
| 3,401,422 | 9/1968 | Ventura | 16/54 |

FOREIGN PATENT DOCUMENTS

| | | | |
|---|---|---|---|
| 604172 | 10/1934 | Fed. Rep. of Germany | 16/68 |
| 19477 | of 1910 | United Kingdom | 16/53 |
| 472123 | 9/1937 | United Kingdom | 16/53 |
| 1282714 | 7/1972 | United Kingdom | 16/58 |

*Primary Examiner*—Wm. Carter Reynolds

*Attorney, Agent, or Firm*—Roylance, Abrams, Berdo & Farley

[57] ABSTRACT

A hydraulic hinge, which can close automatically a door and firmly hold the door at a certain open position without any conventional door closer or door checking device, comprises a casing, a seat having a hexagonal opening therein, a buffer hydraulic mechanism and a spiral reversing spring installed in the casing, and a piston mounted on the buffer hydraulic mechanism and having a hexagonal piston stem extending through the spiral reversing spring to move reciprocatively within the hexagonal opening of the seat.

5 Claims, 26 Drawing Figures

HYDRAULIC HINGE WITH DOOR CLOSING MECHANISM

There is disclosed in the present specification an embodiment of a hydraulic hinge which can close automatically a door and firmly hold the door at a certain open position without any conventional door closer or door checking device, said embodiment comprising a casing, a seat having a hexagonal opening therein, a buffer hydraulic mechanism and a spiral reversing spring installed in the casing, and a piston mounted on the buffer hydraulic mechanism and having a hexagonal piston stem extruding through the spiral reversing spring to move reciprocatively within the hexagonal opening of the seat.

The casing of said embodiment is provided with a hinged arm suitably mounted on one edge of the door and includes a hydraulic cylinder for receiving the hydraulic mechanism, an annular guiding member having two protrusions therein, and a protective sleeve with a cover having an opening therein so as to allow the hexagonal piston stem to extend therethrough and to prevent the spiral reversing spring placed therein from expanding out.

The head of the piston of said embodiment is provided with two inclined grooves thereon for receiving the protrusions of the annular guiding member respectively. Each of the inclined grooves has a non-return means for engaging one of the protrusions of the annular guiding member at a desired position on the corresponding inclined groove. Furthermore, the lower end of the spiral reversing spring is inserted tightly into a hole provided on the piston head, and the upper end of the spring is received in a recess provided on the upper portion of the protective sleeve. Since the seat is fixedly mounted on the door frame, the whole piston with the hydraulic mechanism will be moved upwards by turning the casing or the door. The spring will in turn be spiralled and compressed. When the protrusions of the annular guiding member move to the non-return means of the inclined grooves provided on the piston head, the casing will be stopped, that is to say, the door will be held firmly at a certain position and maintain an open condition. The door will stay in this position until a reverse external force is applied to the door to move the protrusions of the guiding member out of the non-return means of the inclined grooves, after which the door or the casing will return to its original position by the spiralled and compressed spring. To prevent the door returning too quickly, the hydraulic mechanism provides a buffering force to the downward moving piston when the casing returns to its original position by the spring.

The present invention relates to a hydraulic hinge for use in common or special applications.

Heretofore, none of the conventional hinges has the functions of the door closer and of the door checking device. Thus, especially in the business offices, most doors are provided with a hydraulic door closer at the upper portion thereof so as to achieve the goal of closing the door automatically. However, because of their complex construction, the known door closers are relatively expensive and get damaged easily. Furthermore, in common cases, the known door closers are traversely mounted on the upper portion of the door. Accordingly oil leakage may take place after the closers are used for a certain period. In addition, the buffering force supplied by the known door closers may loosen the engaging relation between the conventional hinges and the door, in other words, the screws which are screwed through an opening of the hinged arm into the door so as to ensure the hinges being fixed on the door may be loosened and moved out of the door by the buffering force of the known door closers. This disadvantage becomes more obvious when the door is made of plywood.

Accordingly, it is an important object of the present invention to provide a hydraulic hinge which can perform the function of the known door closer.

It is another important object of the present invention to provide a hydraulic hinge which can perform the function of the known door checking device.

It is a further object of the present invention to provide a hydraulic hinge which can prevent the door from violently striking against the wall behind.

It is still another object of the present invention to provide a hydraulic hinge which can overcome all the previously described disadvantages of the conventional door closers.

These and other objects, features and advantages of the present invention will become more apparent upon reading the following detailed specification and appending drawings, in which.

Figures 1, 2, 3, 4, 5, 6, 7, 8, 9, 10, 11A, 11B, 12A, 12B, 13A, 13B:
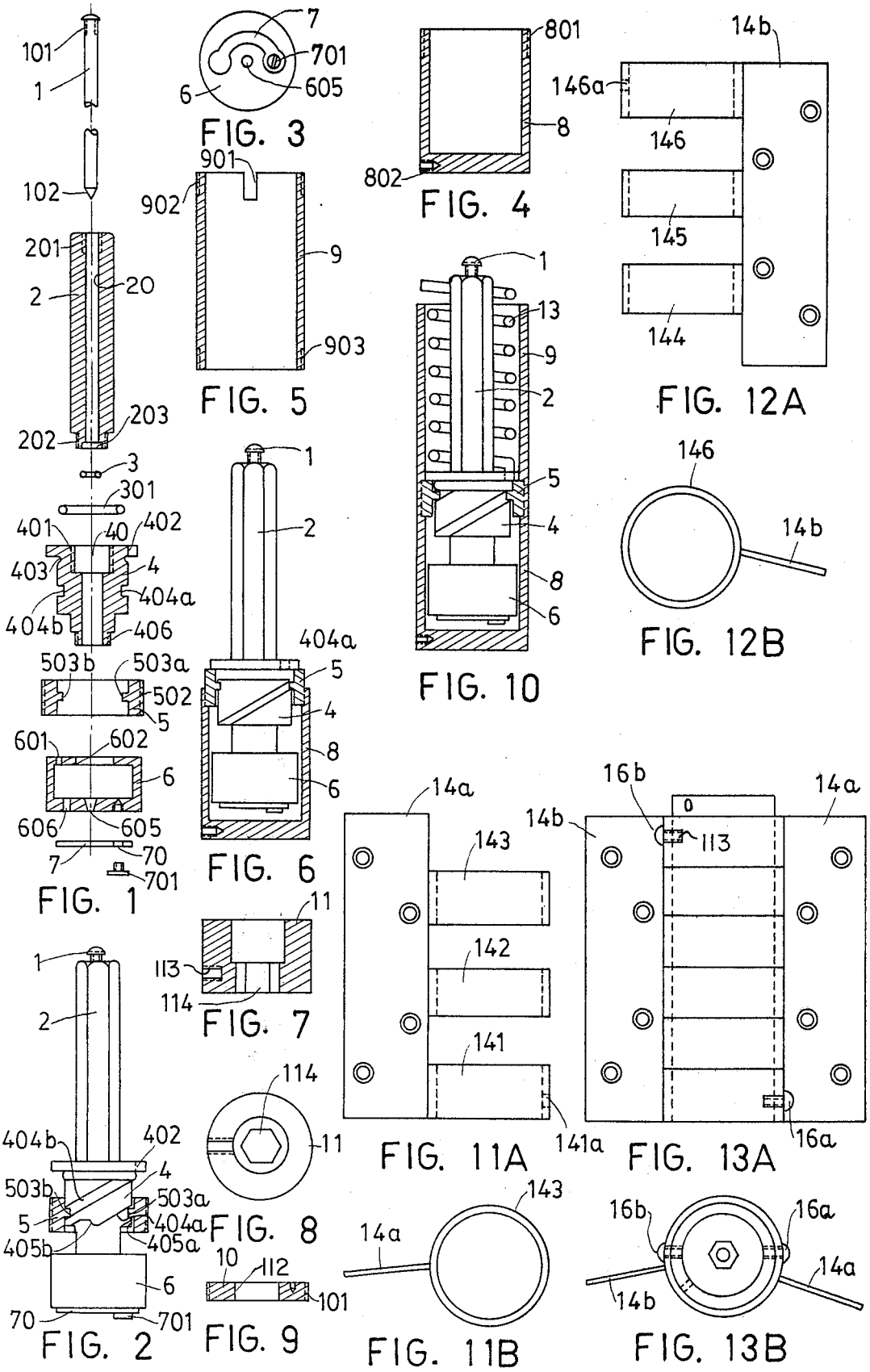
FIG. 1 is an exploded sectional view of the piston, annular guiding member and hydraulic mechanism illustrating their construction relationship.
FIG. 2 is a partial sectional view of the piston, annular guiding member and hydraulic mechanism when assembled.
FIG. 3 is a bottom view of the hydraulic mechanism.
FIG. 4 is a sectional view of the hydraulic cylinder.
FIG. 5 is a sectional view of the protective sleeve.
FIG. 6 is a partical sectional view of the assembled piston, annular guiding member, hydraulic mechanism and hydraulic cylinder, in which the hydraulic mechanism and partial portion of the piston are placed within the hydraulic cylinder, and the lower portion of the annular guiding member is screwed into the upper portion of the hydraulic cylinder.
FIG. 7 is a sectional view of the seat.
FIG. 8 is a top view of the seat.
FIG. 9 is a sectional view of the cover of the protective sleeve.
FIG. 10 is a partial sectional view of the assembled piston, annular guiding member, hydraulic mechanism, hydraulic cylinder, protective sleeve and spring, in which the lower portion of the protective sleeve is screwed onto the upper portion of the annular guiding member, and the spring is placed within the protective sleeve.
FIG. 11A is a side elevation of the first hinge arm.
FIG. 11B is a top view of the first hinge arm.
FIG. 12A is a side elevation of the second hinge arm.
FIG. 12B is a top view of the second hinge arm.
FIG. 13A is a side elevation of said embodiment with the hinge arms.
FIG. 13B is a top view of the said embodiment with the hinge arms.

Referring now to FIGS. 1 to 3, and particularly to FIG. 1, a piston in accordance with the present invention consists of a hexagonal piston stem 2 having an inverted T-shaped passage way 20 therein, a piston head 4 having a T-shaped passage way 40 therein and two inclined grooves 404*a*, 404*b* thereon, two oil seal rings 3, 301, and an adjusting rod 1 extending through the passage ways 20, 40 of the piston stem 2 and the piston head 4. The adjusting rod 1 is threaded at the upper portion 101 thereof and has a coned end 102. Provided in the upper portion of the inverted T-shaped passage way 20 is a female screw thread 201 for threadedly engaging the upper portion 101 of the adjusting rod 1. The oil seal ring 3 is set on the adjusting rod 1 and placed in the lower end 203 of the inverted T-shaped passage way 20. The lower portion of the piston stem 2 is provided with an external screw thread 202. The piston head 4 has a hole 402, an annular groove 403 for receiving the oil seal ring 301, and an external screw thread 406 provided at the lower end thereof. To screw with the piston stem 2 the upper portion of the T-shaped passage way 40 is provided with a female screw thread 401. As best shown in FIG. 2, each of the inclined grooves 404*a*, 404*b* has a upward curved portion 405*a*, 405*b* to act as a non-return means. An annular guiding member 5 has an external screw thread 502 provided thereon and two protrusions 503*a*, 503*b* therein for engaging with the inclined grooves 404*a*, 404*b* of the piston head 4 respectively. A hydraulic mechanism includes a hydraulic chamber 6 having a threaded opening 602 for screwing with the lower end of the piston head 4, a horn-shaped hole 605 for receiving the coned end 102 of the adjusting rod 1, an oil return hole 601 and an oil outlet 606; a damper 7 having an opening 70 therein; and a screw 701 extending through the opening 70 of the damper 7 to screw into the underside of the hydraulic chamber 6. As best shown in FIG. 3, the damper 7 is adapted to buffer or control the flow of the oil through the outlet 606.

FIG. 4 shows a sectional view of a hydraulic cylinder 8 having a female screw thread 801 provided on the upper portion thereof, and a threaded hole 802 on the lower portion thereof for connecting with an arm 14*a* (shown in FIG. 13A) by a screw 16*a*. The upper portion of the hydraulic cylinder 8 can be threadedly engaged with the lower portion of the annular guiding member 5 as shown in FIG. 6.

FIG. 5 shows a sectional view of a protective sleeve 9 having a female screw thread 903 provided on the lower portion thereof for screwing with the upper portion of the annular guiding member 5, and a slot 901 provided on the upper portion thereof. The protective sleeve 9 is further provided with a female screw thread 902 on its upper portion.

Therefore, by the annular guiding member 5 the protective sleeve 9 and the hydraulic cylinder 8 are engaged to form an integral casing as shown in FIG. 10. A spiral reversing spring 13 is placed in the protective sleeve 9, the lower end of the spring being inserted tightly into the hole 402 provided on the piston head 4 and the upper end placed in the slot 901 of the protective sleeve. To prevent the spiral reversing spring 13 from expanding out, a cover 10 with an external screw thead 101 (as shown in FIG. 9) is screwed on the top of the protective sleeve 9. The cover 10 has an opening 112 whose diameter is larger than that of the piston stem 2 but smaller than that of the spiral reversing spring 13 so as to only allow the piston stem 2 to protrude therethrough.

In FIGS. 7 and 8, there is shown a seat 11 mounted on another hinge arm (shown in FIG. 13A) suitably attached to the door frame. The seat 11 has a hexagonal opening 114 therein for slidably receiving the upper portion of the hexagonal piston stem 2 so as to prevent the piston stem 2 from rotating when the casing is turned around. Thus during opening and closing of the door the hexagonal stem 2 slides axially relative to the seat 11 without rotating relative thereto.

In FIGS. 11A and 11B, there is shown a hinge arm 14*a* having three annular sleeves 141, 142 and 143 for receiving the casing, in which the lowest annular sleeve 141 is provided with a through hole 141*a* through which a screw 16*a* is screwed into the threaded hole 802 of the hydraulic cylinder 8 so that the hinge arm 14*a* is integrally coupled with the casing. The hinge arm 14*a* is preferably mounted on one edge of the door.

In FIGS. 12A and 12B, there is shown another hinge arm 14*b* which is preferably mounted on the door frame and has three annular sleeves 144, 145 and 146. The highest sleeve 146 is provided with a through hole 146*a* through which a screw 16*b* is screwed into a threaded hole 113 provided in the seat 11 so that the hinge arm 14*b* can be integrally coupled with the seat 11. Thus, when said assembled embodiment as shown in FIGS. 13A and 13B is mounted on the door and one opens the door, the casing will turn by a certain angle.

Figure 14A:
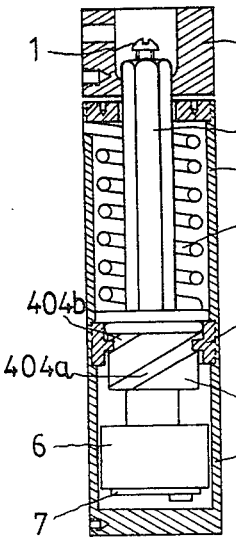
FIGS. 14A, 14B, 14C and 14D are separate sectional views of the embodiment in accordance with the invention illustrating the relationship between the annular guiding member and the piston head, in which the piston with the hydraulic mechanism will be gradually moved upwards by turning the casing comprising the hydraulic cylinder, the annular guiding member and the protective sleeve.
Figure 14B:
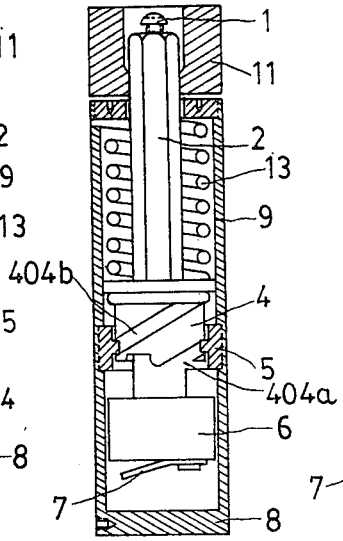
Figure 14C:
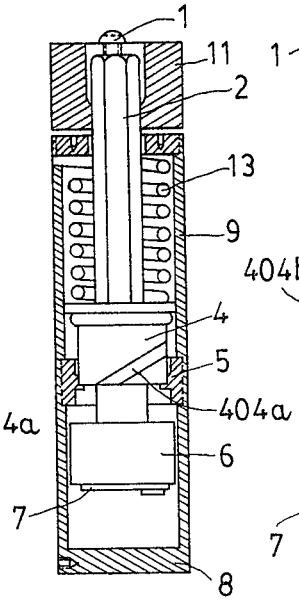
Figure 14D:
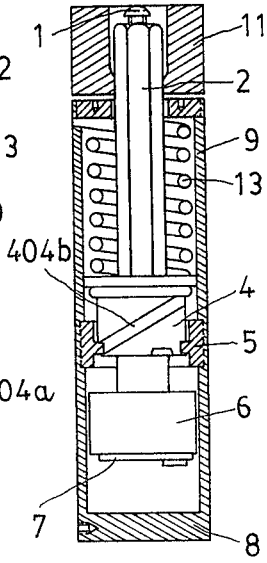
Figure 15A:
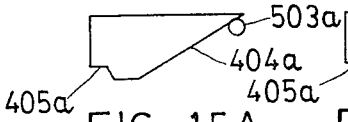
FIGS. 15A, 15B, 15C and 15D are separate schematic illustrations showing the engaging relationship between the protrusions of the guiding member and the grooves of the piston head, corresponding to FIGS. 14A, 14B, 14C and 14D respectively.
Figure 15B:
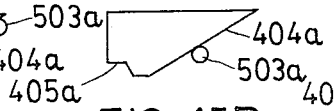
Figure 15C:
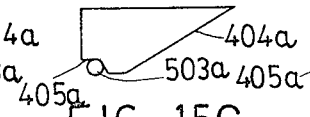
Figure 15D:
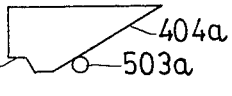

In FIGS. 14A, 14B, 14C and 14D there is shown a sectional view of said assembled embodiment without being coupled with the hinge arms 14*a*, 14*b*. FIG. 14A shows the normal positions of all the structure members of said embodiment when there is no external rotating force applied to the casing. Under such situation, the hydraulic chamber 6 is kept within the lower portion of the hydraulic cylinder 8, and the protrusions 503*a* and 503*b* of the annular guiding member 5 are received within the upper portion of the inclined grooves 404*a* and 404*b* of the piston head 4 respectively (shown in FIG. 15A). As shown in FIG. 14B, if a rotating force is applied to the casing, for instance when one opens the door, the casing will turn by a certain angle to move the piston with the hydraulic mechanism upwardly. Then, the protrusions 503*a* and 503*b* of the annular guiding member 5 will be gradually moved to the lower portion of the inclined grooves 404*a* and 404*b* of the piston head 4 as a result of turning of the casing (shown in FIG. 15B). And one end of the damper 7 will be bent downwards by a suction force produced in the lower portion of the hydraulic cylinder 8 by the upward movement of the piston. Consequently, the oil stored in the hydraulic chamber 6 will flow through the outlet 606 and the horn-shaped hole 605 into the lower portion of the hydraulic cylinder 8 and the spring 13 is spiralled and compressed simultaneously. If the casing is continuously turned, the protrusions 503*a* and 503*b* will be at last moved to and stopped at the upward curved portions 405*a* and 405*b* of the inclined grooves 404*a* and 404*b* as shown in FIGS. 14C and 15C, in other words, the door will be held firmly until a reversing external force is applied thereto. After the casing is held or stopped, the damper 7 gradually returns to its original position to close the outlet 606 of the hydraulic chamber 6.

When a reversing external force is applied to the door to move the protrusions 503*a* and 503*b* out of the curved portions 405*a* and 405*b* of the inclined grooves 404*a* and 404*b* (shown in FIG. 15), the casing and the piston will return to their original positions by the spiralled and compressed spring 13. To buffer the downward movement of the piston, the oil stored in the hydraulic cylinder 8 will flow through the horn-shaped hole 605 into the hydraulic chamber 6. A small amount of oil will flow through the clearance between the hydraulic cylinder 8 and the hydraulic chamber 6 and through the oil return hole 601 into the hydraulic chamber 6. By screwing the adjusting rod 1, the flowing of the buffer oil can be adjusted.

Figure 16:
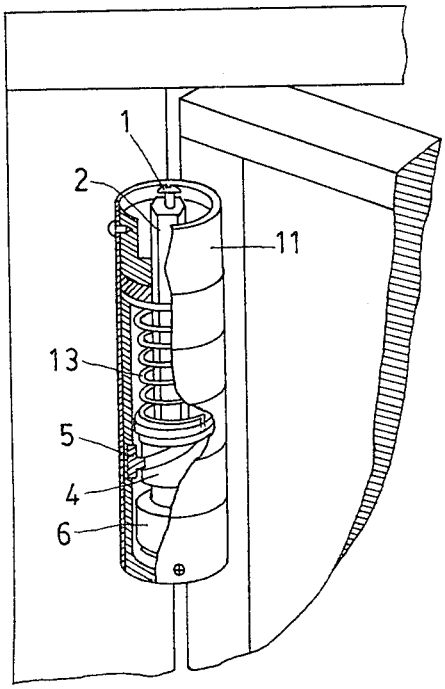
FIG. 16 is a partial exploded perspective view of said embodiment mounted on a door.
Figure 17:
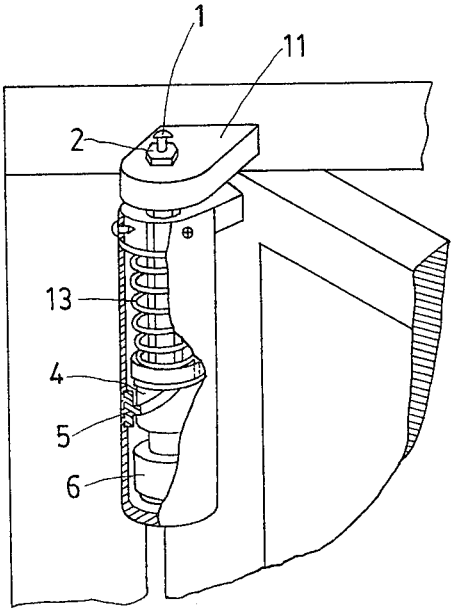
FIG. 17 is another partial exploded perspective view of said embodiment mounted on a door.

In FIGS. 16 and 17, there are shown two embodiments of the present invention in the common applications. However, it is to be understood that many modifications may be made in light of the above teaching. It is therefore to be understood that within the scope of the appended claims the invention may be practiced otherwise.

What I claim is:

1. An apparatus capable of closing automatically a door on which the apparatus is mounted, which comprises:

a cylindrical casing having at least one protrusion thereon and a first stop device thereon, said casing preferably being mounted on one side of the door;

a cover mounted on the top of said casing and having an opening therein;

a piston in said casing having a hexagonal piston stem extending through the opening in said cover, and a piston head provided with a second stop device and at least one inclined groove thereon for receiving the protrustion on said casing, the lower portion of said inclined groove having an upwardly curved portion acting as a non-return device;

a spiral reversing spring whose upper and lower ends are fixed on the first and second stop devices of said casing and said piston respectively;

hydraulic means attached integrally to said piston head and placed in the lower portion of said casing for buffering the movement of said piston during the operation; and a seat having a hexagonal hole therethrough for slidably receiving said hexagonal piston stem, said seat preferably being mounted on the frame of the door, whereby during closure of said door said hexagonal piston stem slides axially relative to said seat but does not rotate relative thereto.

2. An apparatus as claimed in claim 1 wherein said casing comprises a hydraulic cylinder, an annular guiding member and a protective sleeve.

3. An apparatus as claimed in claim 1 wherein said piston has a longitudinal through hole therein.

4. An apparatus as claimed in claim 3 and further comprising an adjusting rod received in and extending through said longitudinal through hole of said piston to adjust the flowing of the fluid stored in said hydraulic means.

5. An apparatus as claimed in claim 4 wherein said hydraulic means substantially comprises a hydraulic chamber having a horn-shaped through hole for receiving the lower end of said adjusting rod, an inlet and an outlet, and a damper provided at the underside of the hydraulic chamber.

* * * * *